US006325227B1

(12) United States Patent
Ekkert

(10) Patent No.: US 6,325,227 B1
(45) Date of Patent: Dec. 4, 2001

(54) TAMPER-INDICATING CLOSURE WITH HORIZONTAL UNDERCUTS

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 09/531,973

(22) Filed: Mar. 20, 2000

(51) Int. Cl.[7] ..... B65D 41/34
(52) U.S. Cl. ..... 215/252; 215/258
(58) Field of Search ..... 215/252, 258

(56) References Cited

U.S. PATENT DOCUMENTS

| | | | | |
|---|---|---|---|---|
| 3,199,703 | | 8/1965 | Alexander . | |
| 3,235,115 | | 2/1966 | Duke . | |
| 3,737,064 | | 6/1973 | Patel et al. . | |
| 3,913,772 | | 10/1975 | Ochs . | |
| 4,087,016 | | 5/1978 | Towns et al. . | |
| 4,156,490 | | 5/1979 | Peraboni . | |
| 4,299,328 | * | 11/1981 | Ochs et al. | 215/252 |
| 4,333,577 | | 6/1982 | Mumford . | |
| 4,418,828 | | 12/1983 | Wilde et al. . | |
| 4,432,461 | | 2/1984 | Mumford et al. . | |
| 4,436,212 | | 3/1984 | Liera . | |
| 4,461,390 | * | 7/1984 | Csaszar | 215/252 |
| 4,479,586 | * | 10/1984 | Csaszar | 215/252 X |
| 4,503,985 | * | 3/1985 | Swartzbaugh et al. | 215/252 |
| 4,506,795 | | 3/1985 | Herr . | |
| 4,511,053 | | 4/1985 | Brandes et al. . | |
| 4,519,516 | | 5/1985 | Amos . | |
| 4,530,437 | | 7/1985 | Gray et al. . | |
| 4,530,438 | | 7/1985 | McDevitt . | |
| 4,549,667 | | 10/1985 | Dullabaun . | |
| 4,595,110 | | 6/1986 | Herr . | |
| 4,609,115 | | 9/1986 | Moore et al. . | |
| 4,613,052 | | 9/1986 | Gregory et al. . | |
| 4,664,278 | * | 5/1987 | Barriac | 215/252 |
| 4,667,838 | * | 5/1987 | Yeager | 215/252 |

(List continued on next page.)

*Primary Examiner*—Allan N. Shoap
*Assistant Examiner*—Robin A. Hylton
(74) *Attorney, Agent, or Firm*—Welsh & Katz, Ltd.

(57) ABSTRACT

A molded tamper-indicating closure for use with an associated container having a finish with an external thread formation and an annular locking collar located axially under the thread formation is disclosed. The locking collar has a circumference, the locking collar defining a locking collar cylindrical plane having a locking collar radius perpendicular to the circumference of the closure. The closure has a cap having a circular top wall portion and an annular skirt portion depending from said top wall portion, said skirt portion having an internal thread formed therein for engaging the container thread. The closure also has a plurality of frangible bridges depending from the skirt portion of the cap. The closure further has an annular ring portion, depending from the skirt and connected thereto by a plurality of frangible bridges, the annular ring portion defining an interior radius that is greater than the locking collar radius, the ring portion defining a top side which is closer to the annular skirt portion than the bottom side, said annular ring portion being, in its entirely, outwardly displaced from said locking collar cylindrical plane. The closure also has a plurality of undercuts integral to and formed on the annular ring portion at a contact plane, and undercuts having a band side, a locking side, and an engaging side, the band side being molded to the annular ring, the locking side having an exterior edge where the band side meets the top side of the annular ring and extending inwardly to an interior edge, the interior edge being inwardly displaced from said locking collar cylindrical plane, and the engaging side sloping outwardly and downwardly from the interior edge of the locking side to the bottom side of the annular ring portion. The closure has the locking side configured to positively lock against the collar ring and the engaging side is configured to urge the undercuts and annular ring portion away from the collar when the closure is applied to the associated container.

14 Claims, 4 Drawing Sheets

U.S. PATENT DOCUMENTS

| | | | | |
|---|---|---|---|---|
| 4,700,859 | | 10/1987 | Gregory . | |
| 4,756,438 | | 7/1988 | Ryder . | |
| 4,899,898 | | 2/1990 | Thompson . | |
| 4,919,285 | | 4/1990 | Roof et al. . | |
| 4,938,370 | * | 7/1990 | McBride | 215/252 |
| 4,978,016 | | 12/1990 | Hayes . | |
| 5,135,123 | | 8/1992 | Nairn et al. . | |
| 5,273,173 | * | 12/1993 | Debetencourt | 215/252 |
| 5,450,972 | * | 9/1995 | Zemlo | 215/252 |
| 5,456,375 | * | 10/1995 | May | 215/252 |
| 5,648,037 | * | 7/1997 | Franchet et al. | 215/252 X |
| 5,736,172 | | 4/1998 | Urmston . | |
| 5,755,346 | | 5/1998 | Ekkert . | |
| 5,806,699 | | 9/1998 | Ekkert et al. . | |
| 5,819,965 | | 10/1998 | King et al. . | |
| 5,853,097 | * | 12/1998 | Ekkert | 215/252 X |
| 5,950,849 | * | 9/1999 | Ekkert et al. | 215/252 |
| 5,967,351 | * | 10/1999 | Ekkert | 215/252 |
| 5,971,182 | * | 10/1999 | Berge et al. | 215/252 |

* cited by examiner

TAMPER-INDICATING CLOSURE WITH HORIZONTAL UNDERCUTS

FIELD OF THE INVENTION

This invention relates to a container closure having an improved tamper-evident band. More particularly, the invention relates to a readily molded tamper-evident closure having undercut engaging elements.

BACKGROUND OF THE INVENTION

Container closures, and more specifically, tamper-indicating or tamper-evident closures are well known in the art. Such closures enable a user to determine whether the container has been previously opened. Various types of tamper-indicating arrangements are known in the art. Many such arrangements include depending tamper-indicating bands. Most of these bands include an inwardly extending portion or projection that engages a locking collar or like annular projection extending from the container finish.

Although such tamper-indicating closures function well for their intended purposes, they can be difficult to manufacture, e.g., mold, without the band separating from the cap after the closure is molded when removing it from the molding apparatus. Moreover, due to the relatively tight tolerances necessary to assure proper function of the closure, such bands can separate from the closure upon initial application (i.e., capping) of the closure onto the container as a result of passing the band over the container threads and locking collar. Further, when a band is too flimsy, or the tolerances too loose, tamper-evident function may be circumvented when the closure can be removed intact after having been applied.

One alternative method of manufacture is to mold the cap and the band separately and use a weld or an adhesive to secure the band to the cap. Such methods complicate the manufacturing processes by requiring the molding of a larger number of parts, and similarly complicate assembly by requiring an adhesion process. Simplicity and reliability of manufacture and assembly are facilitated by forming the closure as a single piece, and applying it to the associated container in a single step.

Another common closure arrangement presents a rounded locking collar in combination with a rounded band, which enables the band to slip over the locking collar for assembly of the closure. Such rounded bands and locking collars present sliding interacting or engaging surfaces which may fail to offer positive locking of the band and the locking collar after assembly. If the tamper-evident band slips over the locking collar, such slippage can result in failure of the tamper-indicating features if the tamper-evident band is completely removed with the cap, without separating from the cap (i.e. unbroken).

Another alternative method that is used to form tamper-indicating closures is to fold, bend, score or crease the beads, wings or tabs (on the inside of the band) after formation, before (and sometimes during) applying the closure to the container. This approach, however, presents limitations similar to closures that are formed by welding—the tamper joint between evident ring, and the cap is not as strong as closures that are formed as one piece. Such welding or manipulation weakens the plastic of the tamper evident band. An unfortunate compromise arising from this solution is that the tamper evident band is more likely to be damaged while being removed from the mold or while being placed on the container. Further, such weakening can make the tamper evident band more prone to accidental separation from the container cap. Such failures can result in containers which appear to have been tampered with, although they have not.

Accordingly, there exists a need for a stronger, readily formed closure that positively locks onto its associated container intact. The stronger closure also resists flexing or bending, and possible failure of the tamper-indicating band during application of the cap onto the container. The closure also resists accidental separation of the tamper-evident band from the cap during shipping, and stocking. In such a closure, the surfaces of the tamper evident band and the locking collar positively lock, and do not present inclined, arcuate, or radial surfaces to each other that could otherwise facilitate slippage of the tamper-evident band. Preferably, such a closure is molded as a single piece in the position of function to preserve the strength of the closure material, without bending or creasing the material, and without the use of adhesives or welding.

SUMMARY OF THE INVENTION

In one embodiment of a molded tamper-indicating closure for use with an associated container, the container has a finish with an external thread formation thereon and including an annular locking collar located axially under the thread formation, the locking collar having a circumference, and the locking collar defining a locking collar cylindrical plane having a locking collar radius perpendicular to the circumference of the closure. The closure is a cap having a circular top wall portion and an annular skirt portion depending from said top wall portion, said skirt portion having an internal thread formed therein for engaging the container thread. The closure also has a plurality of frangible bridges depending from the skirt portion of the cap. The closure has an annular ring portion, depending from the skirt and connected thereto by a plurality of frangible bridges, the annular ring portion defining an interior radius that is greater than the locking collar radius. The ring portion also defines a top side which is closer to the annular skirt portion than the bottom side, said annular ring portion being, in its entirely, outwardly displaced from said locking collar cylindrical plane. The top side of the annular ring defines a top side plane. The closure further has a plurality of substantially horizontal undercuts integral to and formed on the annular ring portion at a contact plane. The undercuts have a band side, a locking side, and an engaging side. The band side is molded to the annular ring, and the locking side has an exterior edge where the band side meets the top side of the annular ring, extending inwardly generally in the plane of the annular ring's top side plane to an interior edge. The interior edge is inwardly displaced from the locking collar cylindrical plane, and the engaging side slopes inwardly and upwardly from the interior edge of the locking side to the bottom side of the annular ring portion. The locking side positively locks against the collar ring and the engaging side urges the undercuts and annular ring portion away from the collar when the closure is applied to the associated container.

In another embodiment, the annular ring portion has a plurality of protrusions integral to and formed on the ring defining a plurality of windows, the annular ring portion depending from the plurality of frangible bridges by the plurality of protrusions and being detachably connected thereto.

In yet another embodiment, the locking surface of the undercut is adjacent to the top side, and the engaging surface is adjacent to the bottom side.

In a still further embodiment, the undercuts extend between protrusions and adjacent and interior to the windows defined by the protrusions.

Another preferred embodiment has undercuts that are sufficiently radially spaced from said skirt wall plane such that said undercuts do not contact said container thread formation when said closure is initially engaged with the container.

DETAILED DESCRIPTION OF THE PREFERRED EMBODIMENTS

Figure 1:
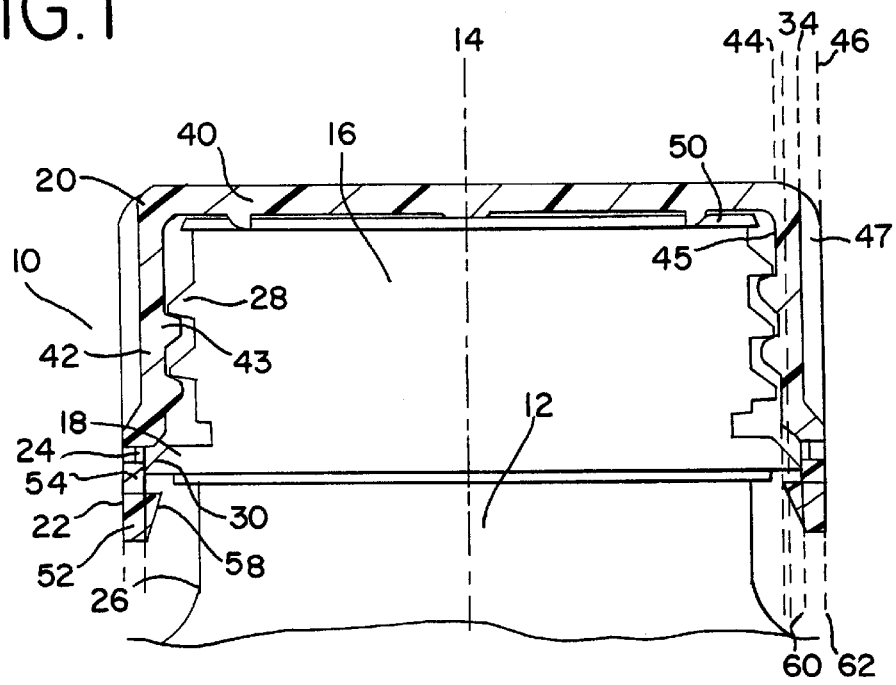
FIG. 1 is a cross-sectional view of a closure embodying the present invention, the closure being illustrated as applied to an associated container.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It will be noted by those skilled in the art that specific dimensions relating to a particular embodiment are provided for example only, and are applicable to the discussion of the described example. Other closure sizes may require different dimensions and tolerances, which other closure sizes and tolerances are all within the scope of the present invention.

Referring now to the figures, and in particular to FIGS. 1–8, there is shown a tamper indicating closure 10 in accordance with the principles of the present invention. The closure 10 is shown in FIG. 1 with an associated container 12 to which the closure 10 is fitted. The closure 10 and container 12 have generally cylindrical shapes, sharing a longitudinal axis as indicated at 14. The associated container 12 includes a finish portion 16 and a collar 18. The closure 10 includes a cap 20 and a tamper-evident band 22 connected to the cap 20 by frangible bridges 24.

The cap 20 covers the associated container 12. The frangible bridges 24 and tamper-evident band 22 are connected to the cap 20 to provide visible indication that the cap 20 may have been removed from the container 12 and that the contents of the container 12 may have been tampered with. The collar 18 serves to provide resistance which facilitates separation of the tamper-evident band 22 from the cap 20 when the cap 20 is removed from the container 12. Removal of the tamper-evident band 22 from the cap 20 provides a visible indication that the closure 10 has been opened or tampered with.

The container finish 16 of the associated container 12 illustrated in FIG. 1 is the portion of the container 12 that includes the container neck 26, and is the portion of the container 12 to which the closure 10 is engaged. The container finish 16 includes an external thread formation 28 thereon for threadedly engaging the closure 10, and includes a locking collar or ring 18 disposed on the container 12, below the container threads 28.

Figure 2:
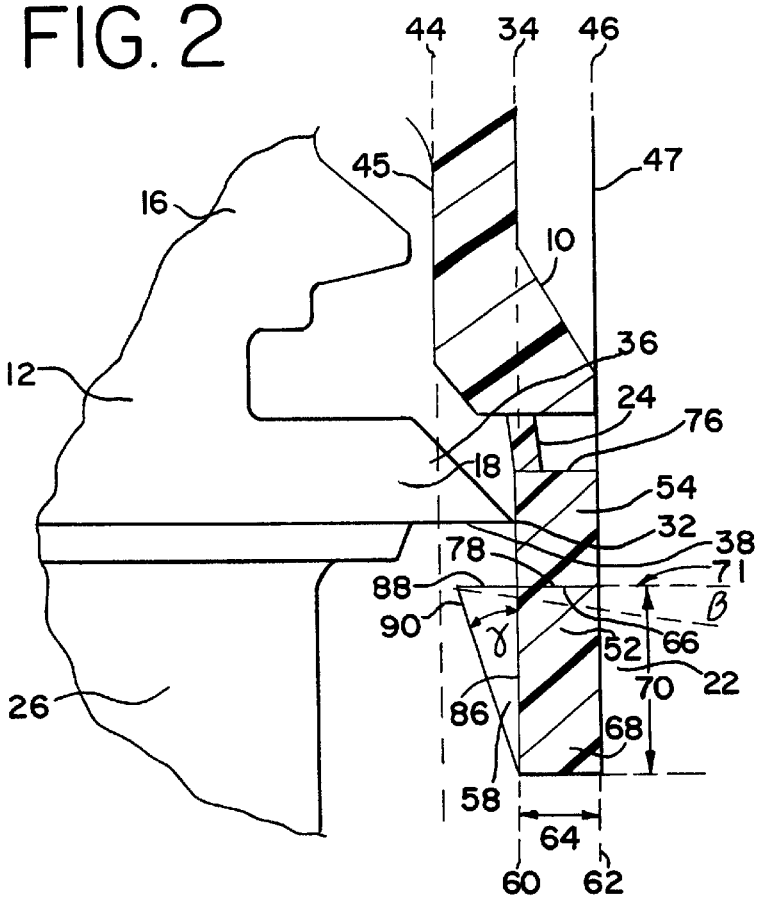
FIG. 2 is an enlarge partial cross-sectional view of the closure and container of FIG. 1 near the edge of the collar of the container.

Referring now to FIGS. 1–2, the locking collar 18 of the container 12 includes a rim 30 at its outermost portion, the outermost portion of the rim 30 being the rim's outer edge 32. The outer edge 32 of the rim 30 circumscribes a circle that defines a cylindrical plane 34 that extends generally parallel to the axis of symmetry 14. The rim 30 has an upper or engaging surface 36. and a lower or locking surface 38.

The engaging surface 36 of the container's locking collar 18 slopes downwardly as it extends outwardly from the container 12 body to the outer edge 32. The slope of the engaging surface 36 interacts with the tamper-evident band 22 when the closure 10 is applied to the container 12 to urge the band 22 outwardly away from the collar 18 as the closure 10 is imposed on the collar 18. The engaging surface 36 is preferably sloped at an angle of about 30° to 60° relative to the axis of symmetry 14, with a slope of about 45° being preferred.

The locking surface 38 of the container's locking collar 18 is generally is preferably perpendicular to the axis of symmetry 14. After the application of the closure 10 to the container 12, the locking surface 38 positively locks the tamper-evident band 22 onto the container neck 26, preventing removal of the tamper-evident band 22 from the container 12. In particular, the locking surface's 38 general lack of a slope configures the locking surface 38 to confront the tamper-evident band 22 during opening of the closure 10, and prevents it from passing over the collar 18.

Figure 3:
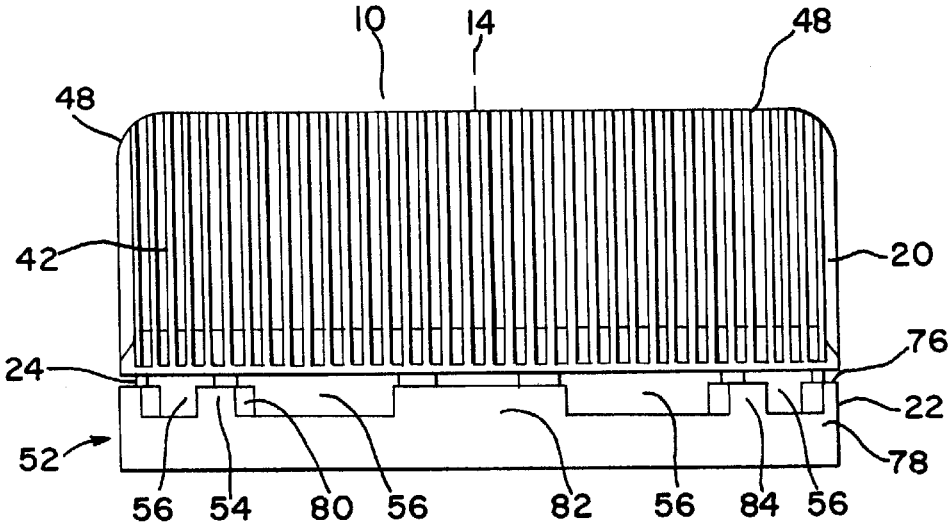
FIG. 3 is a side view of the tamper-evident closure of FIG. 1.

As shown in FIG. 3, the closure 10 includes a cap 20 and a tamper-evident band 22 connected to the cap 20 by a plurality of frangible bridges or connectors 24. The cap 20 serves to seal the container 12 while making the contents of the container 12 available at need. The frangible bridges 24 and tamper-evident band 22 serve to provide visible indication of whether the closure 10 has been removed from the container 12.

Figure 4:
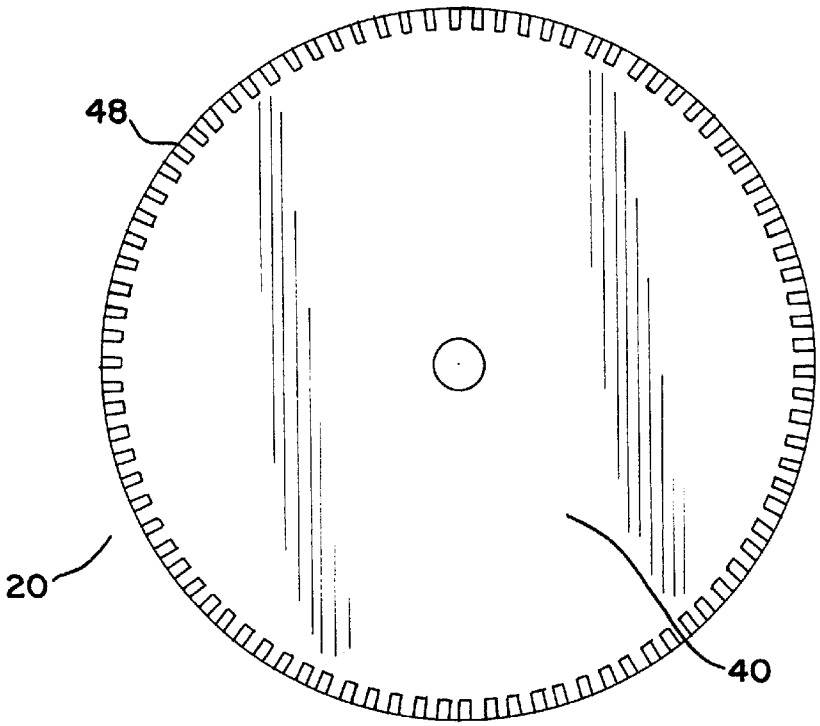
FIG. 4 is a top view of the tamper-evident closure of FIG. 1.
Figure 5:
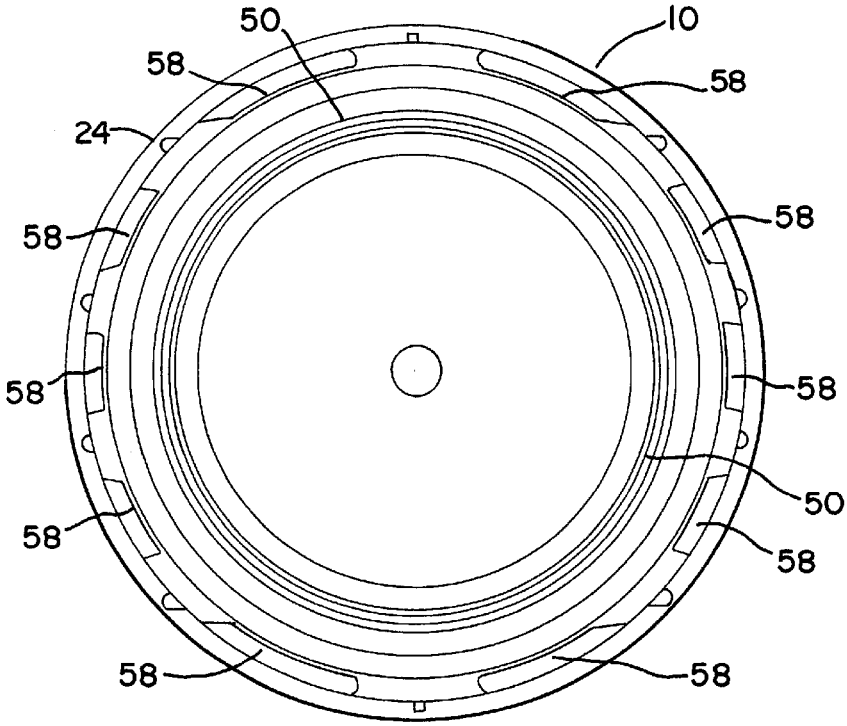
FIG. 5 is a bottom view of the tamper-evident closure of FIG. 1.
Figure 6:
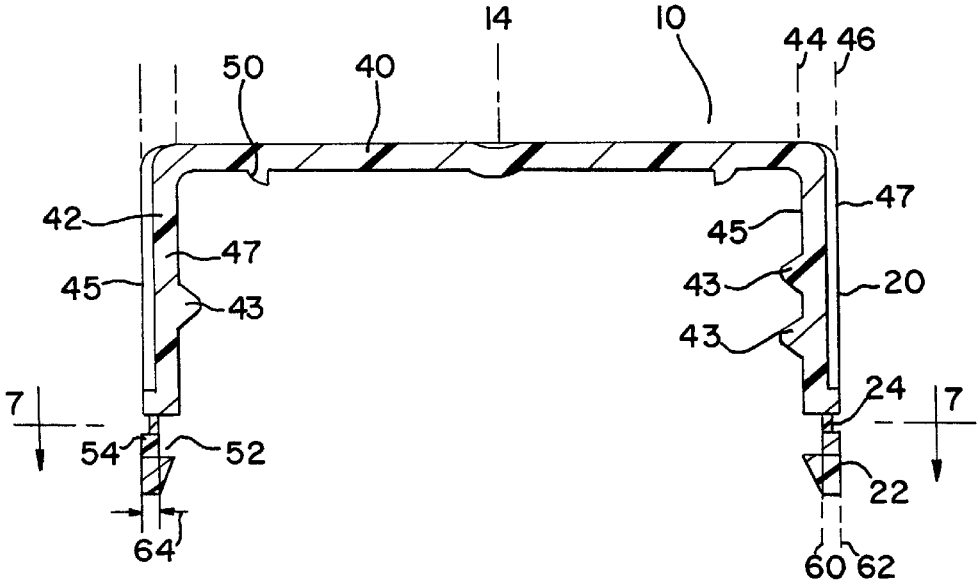
FIG. 6 is a cross-sectional view of the closure similar to FIG. 1, without the associated container for clarity of illustration.

As shown in FIGS. 3–6, the closure 10 includes a cap 20 having a top circular wall portion 40 and a depending annular skirt portion 42 depending from the top wall portion 40. As can be seen in FIG. 6, the skirt portion 42 includes an internal thread 43 formed therein for engaging the container threads 28. The skirt defines a pair of cylindrical planes 44, 46, generally parallel to the axis of symmetry 14, corresponding with the inner and outer walls 45, 47 of the skirt. The radius of the cylindrical plane 44 is the T-radius of the closure.

As illustrated in FIGS. 3 and 4, the cap 20 can include a plurality of undulations 48 on the exterior of the skirt, such as the illustrated shallow ribs or like formations to facilitate grasping the closure 10 to remove it from the container 12. As illustrated in FIGS. 1,5 and 6, the cap 20 can also include sealing rings 50 formed on an inner surface of the top wall 40 to enhance engagement of the cap 20 with the container 12 and thus sealing of the container 12.

The closure 10 also includes a separable, tamper-evident (or tamper-indicating) band 22 that is longitudinally displaced from the skirt 42. Returning to FIG. 3, a preferred embodiment of the tamper-evident band 22 has an annular band portion 52, protrusions 54 (or protuberances, platforms, uprights or teeth) extending upward from the annular band portion 52 which define the windows 56 located between the protrusions 54, and undercuts 58 which extend inwardly from the annular band portion 52. Preferably, as shown in FIGS. 1 and 2, the tamper-evident band 22 is located coextensive with, or within the cylindrical plane 46 defined by the outer wall 47 of the skirt 42, so that the tamper-evident band 22 is less subject to accidental jarring during packing, shipping, and stocking. Further, it is preferred that the innermost portions of the tamper-evident band 22 (e.g., undercuts 58) have a radius sufficiently large such that they are spaced from the container threads 28 on the container neck 26 during application. Even more preferably, the innermost portions 22 (e.g. undercuts 58) of the tamper evident band are spaced outwardly from the T-radius 44.

The annular band portion 52 of the tamper-evident band 22 is a ring that surrounds the container 12. As can be seen in FIGS.1-3, the annular band portion 52 is longitudinally displaced from the skirt portion 42 of the cap 20. The annular band 52 preferably lies entirely outside the circumferential plane 34 defined by the container rim 30, and entirely within the outside radius 46 of the skirt portion 42. The preferred restriction of the inner radius enables the easy application of the closure to the container, while the preferred restriction of the outer radius shelters the annular band 52 during stacking and handling. More preferably, the annular band 52 has a generally rectangular radial cross section. In the illustrated configuration, the annular band 52 has an interior radius 60 and an exterior radius 62 separated by an annular band thickness 64. The annular band 52 also has an top side 66 and a bottom side 68 separated by an annular band height 70. The width and height of the annular band 52 are depicted in FIG. 2. The top side of the annular band defines a top side plane 71.

Figure 7:
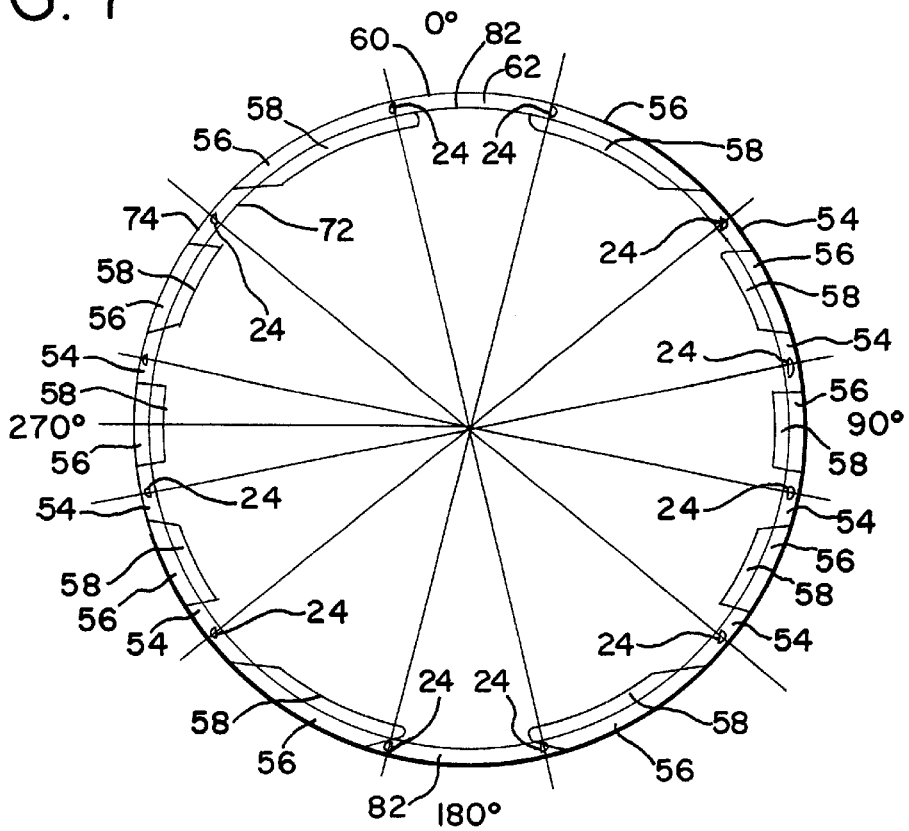
FIG. 7 is a cross-sectioned view of the tamper-evident band taken along line 7—7 of FIG. 6.

As can be seen in FIG. 7, as viewed from above, the annular band 52 is a continuous ring. Preferably, the annular band 52 is pliable which permits the band 52 to adapt to stresses imposed on the ring during the application of the closure 10 to the container 12, as described below.

Figure 8:
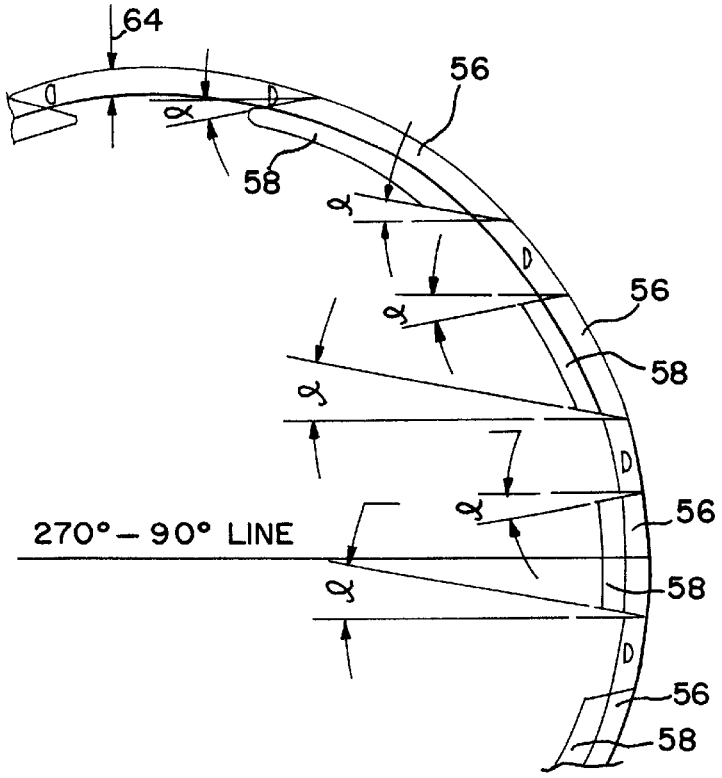
FIG. 8 is an enlarged, partial top view of a section of the tamper-evident band of FIG. 7.

A preferred form of the annular band 52 has protrusions 54 that extend upwardly to define windows 56. As can be seen in FIGS. 3 and 7–8, a plurality of protrusions 54 are formed on the annular band portion 52 and define a plurality of windows 56 located between the protrusions 54. As illustrated in FIG. 3, the protrusions 54 extend upwardly from the annular band portion 52, and define the windows 56 located between the protrusions 54 and above the annular band portion 52. In a preferred embodiment, the protrusions 54 have a generally rectangular radial cross-section as shown in FIG. 2. Each rectangular protrusion 54 has an inner face 72 which faces toward the container 12, an outer face 74 which faces away from the container 12, an upper face 76 which faces toward the skirt, a lower surface 38, which connects the protrusion 54 to the annular band 52, and a pair of window-defining face 80 which oppose the like surfaces of neighboring protrusions 54 to define the windows 56. The generally rectangular radial cross-section is formed by the inner and outer faces 72, 74 being generally parallel to each other, the upper and lower faces 76, 78 being generally parallel to each other and perpendicular to the inner and outer surfaces.

The protrusions 54 and windows 56 are present in equal numbers on the annular band 52. In the embodiment illustrated in FIGS. 1–8, there are ten protrusions 54 and ten windows 56. As can be seen FIG. 7, two large protrusions 82 are located on opposite sides of the band from each other, the first large protrusion 82 defining 0° and the second large protrusion 82 located at 180° around the band from the first large protrusion 82. Intermediate to these two large protrusions 82 are eight medium sized protrusions 84, four on each side of a line connecting the two large protrusions 82, distributed around regions centered at 90° and 270° with respect to the first large protrusion 82. The medium intermediately located protrusions 54, all have sides that are generally oriented along a line from 90° to 270°. This orientation facilitates the insertion of lateral slides (during molding) to help shape the undercuts 58 as well as the protrusions 54.

Preferably, as shown in FIG. 8, the windows 56 defined by the protrusions 54 angle inwardly at an angle $\alpha$ to facilitate opening or retraction of the lateral slides used to form the undercuts 58 beneath and interior to the windows 56. Values of a in the range of 5°–15° are preferred, with values of a near 10° being most preferred.

The windows are formed by slides during molding, such as the lateral slides or the use of radial slides or for that matter, no slides at all. Variations in the slides used to mold the windows will result in a variety of configurations of windows, as will be apparent to those skilled in the art. All such variations of configuration are contemplated by the present invention. Also, while the illustrated annular band portion 52, protrusions 54 and windows 56 are rectangular, the present invention is not intended to limit those parts to such a shape, and other shapes for the band portions, protrusions 54 and windows 56 will be apparent to those skilled in the art, and are contemplated by this invention.

The undercuts 58 facilitate engagement of the closure 10 to the associated container 12 and positively lock the intact closure 10 to the associated container 12 until such time as the tamper-evident band 22 is separated from the cap 20. The undercuts 58 facilitate the separation the tamper-evident band 22 from the cap 20 by preventing the tamper-evident band 22 from riding or slipping over the collar 18. As the cap 20 is twisted to remove it from the container 14, the twisting motion, which urges the cap 20 upwardly riding along the threads 28. The resistance of the band 22 coacting with the collar 18 applying a stress to break the frangible bridges 24 to separate the band 22 from the cap 20.

As can be seen in FIG. 2, each undercut 58 has a band side 86, a locking surface 88, and an engaging surface 90. Positive locking can be achieved when, as illustrated, a substantial portion of the undercut 58 is located inside the circumferential plane 34 defined by the rim 30 of the collar 18, below the collar 18. Like the protrusions 54 and the annular band 52, it is preferable that the undercuts 58 be pliable transverse to the direction of travel to facilitate application of the closure 10 to the associated container 12.

The band surface 86 is integral to and molded from the annular band portion 52 of the tamper-evident band 22. The locking surface 88 is generally perpendicular to the axis of symmetry 14 of the closure 10 and extends inwardly. The locking surface 88 meets the annular band portion's top side 66 and is a continuous extension of that side or surface. The locking surface 88 is in the same general plane as the annular band's top side plane 71. The locking surface 88 and the top side 66 of the annular band 52 are generally aligned to be continuous so that one is substantially an extension of the other. The locking surface 88 and the top side 66 of the annular band 52 are not spaced from each other. This continuity of the top side 66 and the locking surface 88 eases the manufacturing of the closure 10 by facilitating easy removal of the slides that form the undercuts 58 after the closure 10 is molded.

Preferably, however, the locking surface 88 extends slightly upwardly as it extends inwardly from the annular band portion 52. This preferred slight upward angle of the locking surface 88 extends upwardly at an angle β of about 0° to 8° as it extends inwardly, with an upward angle β of 0–5° being even more preferred and with an angle β of about 3° being most preferred.

As illustrated in FIGS. 7–8, in the preferred embodiment having protrusions 54 and windows 56, the undercuts 58 are positioned beneath and interior to the windows 56 to facilitate forming the undercuts 58 by slides of the mold to form the closure 10. Preferably, the undercuts 58 extend fully between adjacent protrusions 54 that defining a corresponding intermediate window 56, and taper at about the same angle a as the windows 56 do as they extend inwardly.

Returning to FIG. 2, each undercut 58 also has an engaging surface 90. The engaging surface 90 expands from the inward-most part of the locking surface 88 to the bottom of the band side 86, and is inclined inwardly as it extends upwardly. Preferably, the angle of the engaging surface 90 relative to the axis of symmetry 14, γ is about 10° to 45°, and more preferred is about 20°–35°, and most preferred, about 27°. The engaging surface 90 is configured to interact with the engaging surface 36 of the lip portion so that when downward force is applied to the closure 10, the engaging surface 90 cooperates with the upper surface 36 of the lip to urge the tamper-evident ring 22 outward so that the undercuts 58 of the tamper-evident ring slip over the collar 18, and yet urges the band towards the container during removal.

The combination of the band side 86, locking surface 88, and engaging surface 90 form a substantially solid radial cross-section integral to the annular band portion 52. This solid structure preferably extends to form a complete extension of the annular band's top side 66 behind the windows 56. As illustrated in FIG. 2, the locking surfaces 88 are adjacent to the top face of the annular band 52 which defines the bottom of the windows 56 and slope upwardly along the entire length of the exposed top side 66 not covered by the protrusions 54.

The undercuts 58, like the annular band 52 on which they are formed, are preferably pliable in order to facilitate passage of the tamper-evident band 22 over the collar 18 during application.

The undercuts 58, are formed in their final position during the molding process. Because the undercuts 58 are formed in their final position during molding, rather than being folded, crimped or otherwise formed after molding, they have been observed to have greater structural strength or integrity. This is due, in part, to the elimination of a weakened area or region that is typically found in such after-molding formed hooks. As will be recognized by those skilled in the art, such a weakened region can reduce the strength of the closure 10, which can increase the opportunity for unwanted breakage of the closure 10 at that region. The present molded undercuts 58 can better withstand the forces exerted thereon during the capping process, thus reducing the number of caps 20 rejected as a result of inadvertent band separation.

The tamper-evident band 22 is connected to the cap 20 by a plurality of frangible bridges 24. In a preferred embodiment, illustrated in FIGS. 7–8, each of the frangible bridges 24 has a semicircular cross-section between the cap 20 and the band 22. Each of the frangible bridges 24 preferably has a diameter greater than its length. For example, in a 1" cap 20, each of the frangible bridges 24 is short, for example less than about 0.05" in length, and preferably a length of about 0.03". The short, wide bridges survive assembly of the closure 10 to the container 12 better than longer, narrower bridges. In the preferred embodiment with protrusions 54 and windows 56, illustrated in FIGS. 7–8, the frangible bridges 24 connect to the annular band 52 at the tops of the protrusions 54.

The closure 10 is applied to its associated container 12 by pressing the closure 10 down onto the container 12. When applying a closure 10 to its associated container 12, there is a significant risk of breaking the tamper-evident closure 10 owing to the stresses of application. In particular, as mechanical force twists the threaded parts of the cap 20 and the container 12 together, the tamper-evident band 22 engages and is forced over the rim 30 of the collar 18. Forcing the tamper-evident ring over the collar 18 imparts substantial stresses to the tamper-evident band 22 because the tamper-evident band 22 must be forced away from the collar 18 in order to pass over the collar 18.

One advantage of the present invention is the strength of the structure of the closure 10 for both the purpose of surviving application and the purpose of positively locking the closure 10 after application. Many conventional closures 10 achieve the survival of the intact closure 10 by bending or creasing the closure 10 during application in order to achieve the locking purpose, and therein weaken the closure's 10 ability to seal the associated container 12 or survive accidental impacts. The undercuts 58 of the preferred embodiment are solid, and formed in the position of function. That is, the structure of the exemplary closure 10 is the same both before and after application, and is preferably free of weakening induced by folding, bending, creasing, or welding to achieve its function.

The preferred embodiment uses protrusions 54 to space the undercuts 58 from the frangible bridges 24. During application of the closure 10 to the container 12, the contact between the collar 18 and the undercuts 58 imparts stress to the tamper-evident band 22 as the collar 18 forces the tamper-evident band 22 outward. The stress placed on the frangible bridges 24 by the expansion of the tamper-evident ring is decreased the farther away the point of contact between the tamper-evident ring 52 and the collar 18 is from the frangible bridges 24. A displacement of the frangible bridge 24 can be defined by the distance that the base of the protrusion 54 must be displaced outwardly from its at rest position in order to accomplish the application of the closure 10 and the distance between the base of the protrusion 54 and the frangible bridges 24. The effect of this displacement on the frangible bridges 24 is decreased with an increase in the length of the protrusion. Preferably, the protrusion 54 is made of a flexible material and will further decrease the stress experienced by the frangible bridge 24 by flexing to absorb some of the induced stress.

In the preferred embodiment which uses protrusions 54 and windows 56, the stress of application can also be reduced by the configuration of the annular ring portion 52. The portions of the annular ring portion 52 which are between the outer faces 74 of the undercuts 58 can be arcs in the at rest position. When the undercuts 58 are urged away from the collar 18, the arcs can straighten to alleviate some of the stress imparted to the tamper-evident band 22 during application of the closure 10 to the container 12.

When the cap 20 is appropriately turned, engagement of the cap and container threads 43, 28, respectively urge the closure 10 upward. The upward movement brings the undercuts 58 of the tamper-evident band 22 inward into contact with the locking surface of the collar 18.

Continued turning of the cap 20 increases the force that the collar 18 and the tamper-evident band 22 apply to each other. Simultaneously, the friction between the collar 18 and the tamper-evident band 22 generates a shearing force which applies transversely to the frangible bridges 24, which in combination with the longitudinal tension, causes the frangible bridges 24 to break, removing the tamper-evident band 22 from the cap 20. Detaching the band from the cap 20 provides visually discernible evidence that the cap 20 has been removed from the container 12.

In addition to the advantages noted above, the present closure 10 provides advantages during the molding process not attendant with many of the known closures. One such advantage, as will be recognized by those skilled in the art, is that the obtuse angles present where the protuberances join the annular band 52, the slight upward angle of the undercuts 58 as the undercuts extend inwardly, and a slight tapering of the closure 10 as a whole as it extends upwardly facilitate ready removal of the closure 10 from the mold.

Additionally, in manufacture of the closure 10, the closure 10 is molded in its "resting", engaged, least-stress position. This can reduce the steps necessary to manufacture the closure 10 and cap the container 12.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A molded tamper-indicating closure for use with an associated container, the container having a finish with an external thread formation thereon and including an annular locking collar located axially under the thread formation, the locking collar having a circumference, the locking collar defining a locking collar cylindrical plane having a locking collar radius perpendicular to the circumference of the closure, the closure comprising:

a cap having a circular top wall portion and an annular skirt portion depending from said top wall portion, said skirt portion having an internal thread formed therein for engaging the container thread;

a plurality of frangible bridges depending from the skirt portion of the cap;

an annular ring portion, depending from the skirt and connected thereto by the plurality of frangible bridges, the annular ring portion defining an interior radius that is greater than the locking collar radius, the ring portion defining a top side which is closer to the annular skirt portion than a bottom side also defined by the ring portion, the top side defining a top side plane, said annular ring portion being, in its entirety, outwardly displaced from said locking collar cylindrical plane;

and a plurality of substantially triangular undercuts integral to and formed on the annular ring portion at a contact plane, and undercuts having a band side, a locking side, and an engaging side, the band side being molded to the annular ring, the locking side having an exterior edge where the band side meets the top side of the annular ring and extends inwardly in generally the same horizontal plane as the top side plane to an interior edge, the interior edge being inwardly displaced from said locking collar cylindrical plane, the locking ring being sloped upwardly at an angle of greater than 0° and up to about 5° as it extends inwardly from the exterior edge towards the interior edge, and the engaging side sloping outwardly and downwardly from the interior edge of the locking side to the bottom side of the annular ring portion, wherein the locking side positively locks against the collar ring and the engaging side urges the undercuts and annular ring portion away from the collar when the closure is applied to the associated container.

2. A molded closure, as in claim 1, the annular ring portion having a plurality of protrusions integral to and formed on the ring defining a plurality of windows, the annular ring portion depending from the plurality of frangible bridges by the plurality of protrusions and being detachably connected thereto.

3. A molded closure as in claim 1, wherein the locking surface of the undercut extends upwardly 3° as it extends inwardly.

4. A molded closure as in claim 1, wherein the engaging surface of the undercut extends inwardly 10°–45° as it extends upwardly.

5. A molded closure as in claim 1, wherein the engaging surface of the undercut extends inwardly 20°–35° as it extends upwardly.

6. A molded closure as in claim 1, wherein the engaging surface of the undercut extends inwardly 27° as it extends upwardly.

7. A molded closure as in claim 1, the locking surface of the undercut being adjacent to the top side of the annular ring, and the engaging surface being adjacent to the bottom side of the annular ring.

8. A molded closure as in claim 2, the undercut extending between protrusions and adjacent and interior to the windows defined by the protrusions.

9. The molded tamper-indicating closure in accordance with claim 1, wherein said undercuts are sufficiently radially spaced from said skirt wall plane such that said undercuts do not contact said container thread formation when said closure is initially engaged with the container.

10. The molded tamper-indicating closure in accordance with claim 1, including about 2 to about 32 undercuts.

11. The molded tamper-indicating closure in accordance with claim 1, including about 8 to about 16 undercuts.

12. The molded tamper-indicating closure in accordance with claim 1, including about 10 undercuts.

13. The molded tamper-indicating closure in accordance with claim 1, wherein the tamper-evident ring is entirely outside the T-radius.

14. A molded tamper-indicating closure for use with an associated container, the container having a finish with an external thread formation thereon and including an annular locking collar located axially under the thread formation, the locking collar having a circumference, the locking collar defining a locking collar cylindrical plane having a locking collar radius perpendicular to the circumference of the closure, the closure comprising:

a cap having a circular top wall portion and an annular skirt portion depending from said top wall portion, said skirt portion having an internal thread formed therein for engaging the container thread, the interior wall of said skirt portion defining a T-radius;

a plurality of frangible bridges depending from the skirt portion of the cap;

an annular ring portion defining an interior radius that is greater than the locking collar radius, the ring portion defining a top side which is closer to the annular skirt portion than the bottom side, said annular ring portion being, in its entirely, outwardly displaced from said locking collar cylindrical plane, the annular ring portion having a plurality of protrusions integral to and formed on the ring defining a plurality of windows, the annular ring portion depending from the plurality of frangible bridges by the plurality of protrusions and being detachably connected thereto;

and a plurality of substantially triangular undercuts integral to and formed on the annular ring portion at a contact plane, and undercuts having a band side, a locking side, and an engaging side, the band side being molded to the annular ring, the locking side having an exterior edge where the band side meets the top side of the annular ring and extending inwardly to an interior edge, the interior edge being inwardly displaced from said locking collar cylindrical plane and horizontally adjacent to the top side of the annular ring portion, and the engaging side sloping inwardly and upwardly from the interior edge of the locking side to the bottom side of the annular ring portion and being adjacent to the bottom side, the undercuts extending between protrusions and adjacent and interior to the windows defined by the protrusions, the undercuts being sufficiently radially spaced from said skirt wall plane such that said undercuts do not contact said container thread formation when said closure is initially engaged with the container and such that said undercuts lie entirely outside the T-radius;

wherein the locking side positively locks against the collar ring and the engaging side urges the undercuts and annular ring portion away from the collar when the closure is applied to the associated container.

* * * * *